US010745990B2

(12) United States Patent
Lambert et al.

(10) Patent No.: US 10,745,990 B2
(45) Date of Patent: Aug. 18, 2020

(54) SHEAR RAMS FOR A BLOWOUT PREVENTER

(71) Applicant: Cameron International Corporation, Houston, TX (US)

(72) Inventors: Jeffrey Lambert, Tomball, TX (US); Raul Araujo, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 162 days.

(21) Appl. No.: 15/647,621

(22) Filed: Jul. 12, 2017

(65) Prior Publication Data

US 2019/0017343 A1 Jan. 17, 2019

(51) Int. Cl.
*E21B 33/06* (2006.01)
*E21B 33/037* (2006.01)

(52) U.S. Cl.
CPC ..... *E21B 33/063* (2013.01); *E21B 33/0375* (2013.01)

(58) Field of Classification Search
CPC ..... E21B 33/063; E21B 33/0375
USPC ..... 166/85.4
See application file for complete search history.

(56) References Cited

U.S. PATENT DOCUMENTS 4,081,027 A * 3/1978 Nguyen ..... E21B 29/08 116/55
4,540,046 A * 9/1985 Granger ..... E21B 29/08 166/55
6,244,336 B1 * 6/2001 Kachich ..... E21B 29/08 166/55
2012/0217018 A1 * 8/2012 Zediker ..... E21B 33/063 166/361

* cited by examiner

*Primary Examiner* — Taras P Bemko
(74) *Attorney, Agent, or Firm* — Helene Raybaud

(57) ABSTRACT

The present disclosure relates to a system that includes a shearing ram configured to mount in a blowout preventer. The shearing ram includes a body portion that may move along an axis of movement. The shearing ram also includes a sealing member disposed in a first surface of the body portion. The sealing member is biased away from the first surface in a crosswise direction relative to the axis of movement, such that the sealing member may engage a second surface of a second shearing ram when the first shearing ram and the second shearing ram overlap with one another with respect to the axis of movement.

20 Claims, 11 Drawing Sheets

SHEAR RAMS FOR A BLOWOUT PREVENTER

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) stack may be installed on a wellhead to seal and control an oil and gas well during drilling operations. A tubular string may be suspended inside a drilling riser and extend through the BOP stack into the wellhead. During drilling operations, a drilling fluid may be delivered through the tubular string and returned through a bore between the tubular string and a casing of the drilling riser. In the event of a rapid invasion of formation fluid in the bore, commonly known as a "kick," the BOP stack may be actuated to seal the drilling riser from the wellhead and to control a fluid pressure in the bore, thereby protecting well equipment disposed above the BOP stack.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
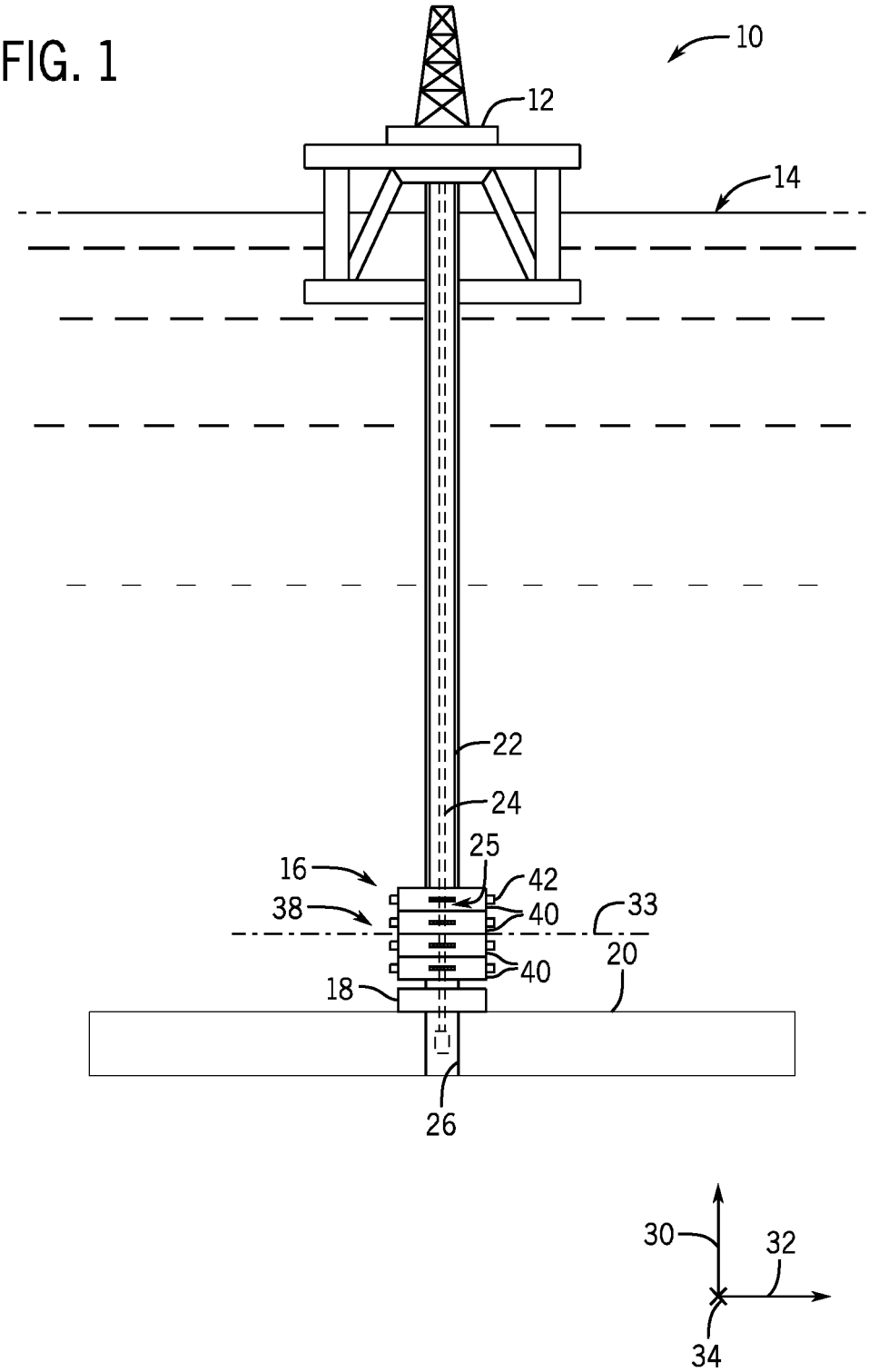
FIG. 1 is a schematic diagram of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present disclosure relate to a blowout preventer ("BOP") system that may substantially or completely shear (e.g., cut) a tubular string to form a seal in a wellbore when a kick (e.g., a blowout condition) is detected. A BOP may be included at a wellhead to block a fluid from inadvertently flowing from the wellhead to a drilling platform (e.g., through a drilling riser). For example, pressures may fluctuate within a natural reservoir, which may lead to a surge in fluid flow from the wellhead toward the drilling platform when the pressure reaches a threshold value. To block fluid from flowing toward the drilling platform during a kick and/or a blowout condition, the BOP may be actuated to cut the tubular string and seal the drilling riser from the wellhead (e.g., by covering a bore in the BOP coupling the wellhead to the drilling riser). In accordance with embodiments of the present disclosure, at least one BOP of a BOP stack may include improved shearing rams that may be configured to cut the tubular string with increased shear force and reduced input force and form a seal within the bore extending through the BOP.

Shearing rams of a ram BOP may include a tapered surface that forms an edge with a second surface. The edge contacts a tubular string and applies a force against the tubular string, which ultimately causes the tubular string to shear. In some cases, portions of the tapered surface may also contact the tubular string and create resistance to the shearing of the tubular string. For example, the portions of the tapered surface that contact the tubular string may spread a shear force of the shearing rams axially along the tubular string, which may reduce an amount of shear force applied to the tubular string and increase an amount of input force used to shear the tubular string.

Accordingly, embodiments of the present disclosure are related to shearing rams that include a ledge that concentrates the shear force applied to the tubular string in substantially a single plane (e.g., within 80%, within 85%, within 90%, within 95%, or within 99% of a single plane formed by one or more ledges) or completely in the single plane. In other words, the ledge may be included on opposing shearing rams to create one or more openings in the tubular string as the opposing shearing rams move toward one another. The shear force applied to the tubular string by the ledge(s) may be substantially or completely in the single plane. Including the ledge in the shearing rams may increase an amount of shear force applied to the tubular string and reduce an amount of input force used to shear the tubular string, because of the concentration of the shear force within the substantially single plane. For example, including the ledge in the shearing rams may provide a greater shear force per input force from an actuator (e.g., a hydraulic actuator) of the BOP, thereby enabling the BOP to operate more efficiently and/or effectively without installing larger and/or more powerful actuators.

It may be desirable to increase the shear force applied to the tubular string and reduce an amount of input force to shear the tubular string when the BOP is positioned at increased depths from a platform and/or surface of a mineral extraction system. For example, pressure may increase within the wellbore as the distance from the platform and/or surface of the mineral extraction system increases, thereby increasing an amount of shear force that is utilized to shear the tubular string. Further, a thickness, diameter, and/or material composition of the tubular string may increase at greater depths from the platform and/or the surface of the mineral extraction system. To shear the tubular string with an increased thickness, an increased diameter, and/or a more robust material composition, a larger shear force is applied. Accordingly, the shearing rams of the present disclosure may facilitate shearing of tubular strings within a BOP positioned at increased depths from a platform and/or surface of a mineral extraction system.

With the foregoing in mind, FIG. 1 is a schematic of an embodiment of a mineral extraction system 10. The mineral extraction system 10 includes a vessel or platform 12 at a surface 14. A BOP stack assembly 16 is mounted to a wellhead 18 at a floor 20 (e.g., a sea floor for offshore operations). A tubular drilling riser 22 extends from the platform 12 to the BOP stack assembly 16. The riser 22 may return drilling fluid or mud to the platform 12 during drilling operations. Downhole operations are carried out by a tubular string 24 (e.g., drill string, production tubing string, or the like) that extends from the platform 12, through the riser 22, through a bore 25 of the BOP stack assembly 16, and into a wellbore 26.

To facilitate discussion, the BOP stack assembly 16 and its components may be described with reference to an axial axis or direction 30, a second axis or direction 32 extending longitudinally along a centerline 33 of the BOP stack assembly 16 (e.g., crosswise to the axial axis or direction 30), and a third axis or direction 34 (e.g., cross wise to the axial axis or direction 30 and the second axis or direction 32). As shown, the BOP stack assembly 16 includes a BOP stack 38 having multiple BOPs 40 (e.g., ram BOPs) axially stacked (e.g., along the axial axis 30) relative to one another. As discussed in more detail below, each BOP 40 includes a pair of longitudinally opposed rams and corresponding actuators 42 that actuate and drive the rams toward and away from one another along the second axis 32. Although four BOPs 40 are shown, the BOP stack 38 may include any suitable number of the BOPs 40 (e.g., 1, 2, 3, 4, 5, 6, 7, 8, 9, 10, or more BOPs 40). Additionally, the BOP stack 38 may include any of a variety of different types of rams. For example, in certain embodiments, the BOP stack 38 may include one or more BOPs 40 having opposed shear rams or blades configured to sever the tubular string 24 and seal off the wellbore 26 from the riser 22 and/or one or more BOPs 40 having opposed pipe rams configured to engage the tubular string 24 and to seal the bore 25 (e.g., an annulus around the tubular string 24).

Figure 2:
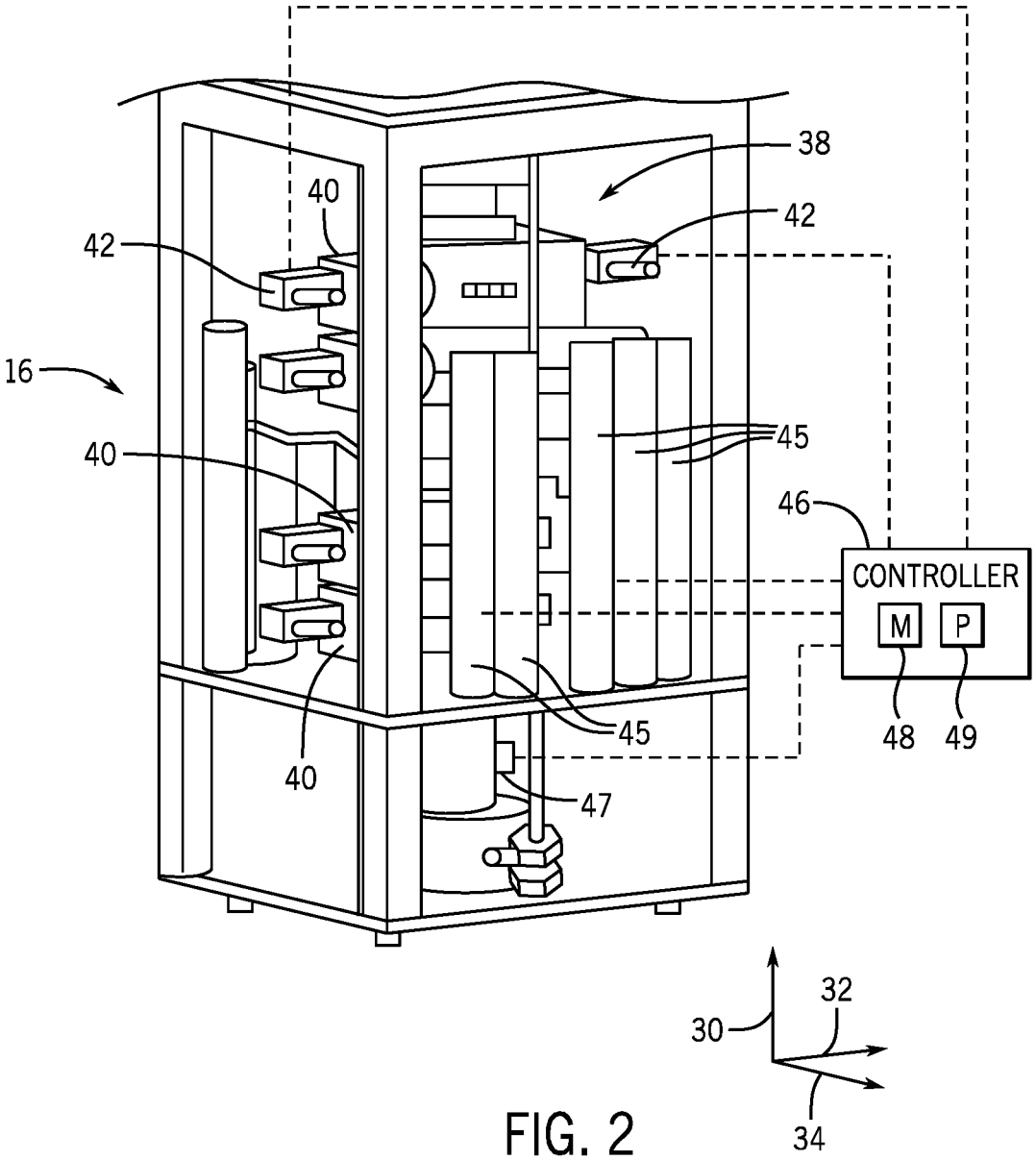
FIG. 2 is a perspective view of an embodiment of a BOP stack assembly that may be used in the mineral extraction system of FIG. 1, in accordance with an embodiment of the present disclosure.

FIG. 2 is a perspective view of an embodiment of the BOP stack assembly 16. As discussed above, the BOP stack 38 includes multiple BOPs 40 axially stacked (e.g., along the axial axis 30) relative to one another. As shown, the BOP stack 38 also includes one or more accumulators 45 (e.g., hydraulic accumulators, pneumatic accumulators, electric accumulators, etc.). In some embodiments, the accumulators 45 store and/or supply (e.g., via one or more pumps) hydraulic pressure to the actuators 42 that are configured to drive the rams of the BOPs 40. In certain embodiments, the accumulators 45 and/or the actuators 42 may be communicatively coupled to a controller 46. The controller 46 may be configured to send signals to the accumulators 45, the actuators 42, and/or one or more pumps to drive the rams of the BOPs 40 when blowout conditions exist. For example, the controller 46 may receive feedback from one or more sensors 47 (e.g., pressure sensors, temperature sensors, flow sensors, vibration sensors, and/or composition sensors) that may monitor conditions of the wellbore 26 (e.g., a pressure of the fluid in the wellbore 26). The controller 46 may include memory 48 that stores threshold values indicative of blowout conditions. Accordingly, a processor 49 of the controller 46 may send a signal instructing the accumulators 45, the actuators 42, and/or the one or more pumps to drive and/or actuate the rams when measured feedback received from the controller 46 meets or exceeds such threshold values.

Figure 3:
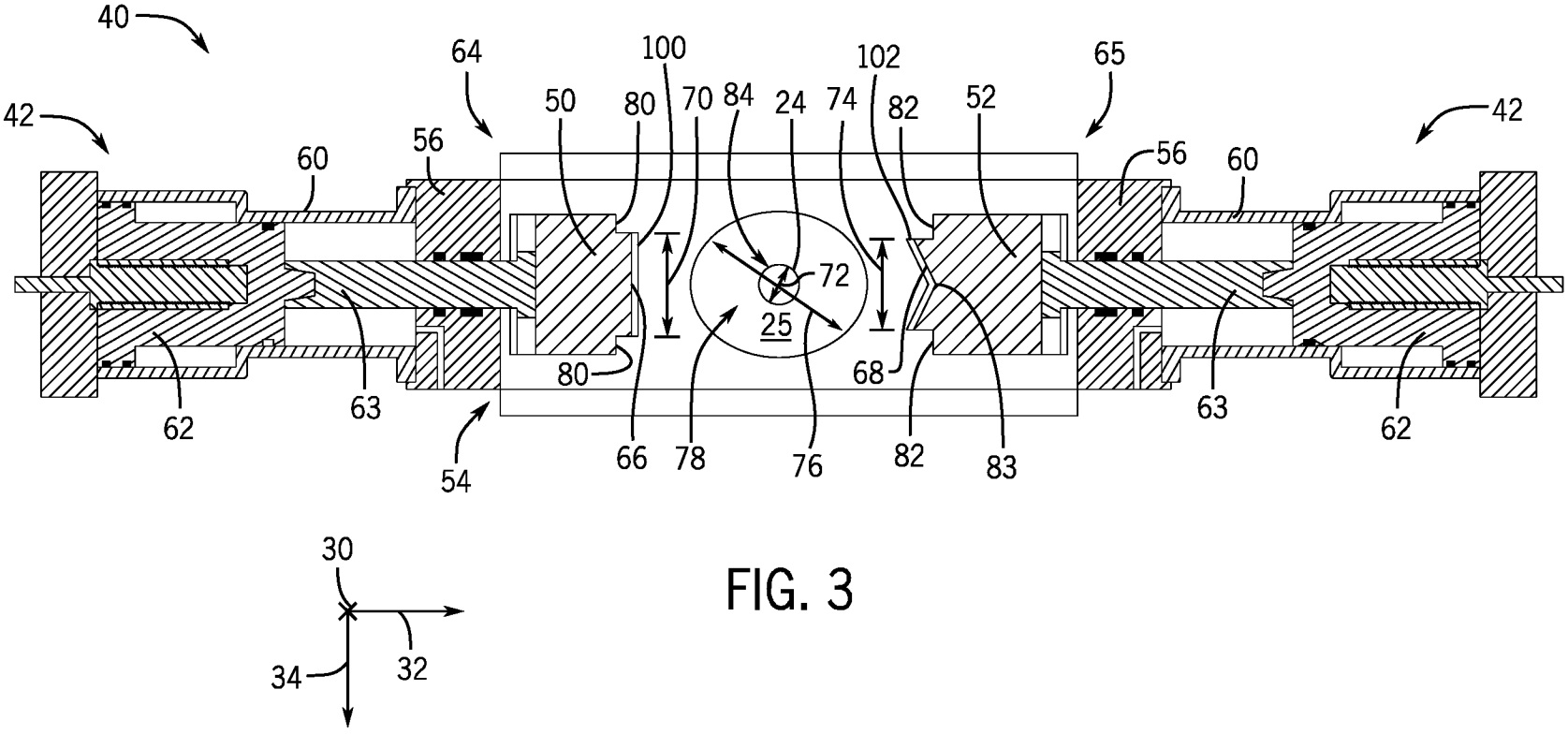
FIG. 3 is a cross-sectional top view of a portion of a BOP of the BOP stack assembly of FIG. 2, illustrating first and second rams in an open position, in accordance with an embodiment of the present disclosure.

FIG. 3 is a cross-sectional top view of a portion of one BOP 40 with a first ram 50 and a second ram 52 in a normal or default position 54. In the default position 54, the first ram 50 and the second ram 52 are withdrawn or retracted from the bore 25, do not contact the tubular string 24, and/or do not contact the corresponding opposing ram 50, 52. As shown, the BOP 40 includes a body 56 (e.g., housing) surrounding the bore 25. The body 56 is generally rectangular in the illustrated embodiment, although the body 56 may have any cross-sectional shape, including any polygonal shape or an annular shape. A plurality of bonnet assemblies 60 are mounted to the body 56 (e.g., via threaded fasteners). In the illustrated embodiment, first and second bonnet assemblies 60 are mounted to diametrically opposite sides of the body 56. Each bonnet assembly 60 supports an actuator 42, which includes a piston 62 and a connecting rod 63. As shown in the illustrated embodiment of FIG. 3, when in the default position 54, the first ram 50 is generally adjacent to a first end 64 of the body 56 and the second ram 52 is generally adjacent to a second end 65 opposite the first end 64 of the body 56. The actuators 42 may drive the first and second rams 50, 52 toward and away from one another along the second axis 32 and through the bore 25 to shear the tubular string 24 and/or to seal the bore 25 (e.g., the annulus about the tubular string 24).

The first ram 50 may include a first shearing portion 66, and the second ram 52 may include a second shearing portion 68. The first shearing portion 66 may include a first width 70 that is greater than a diameter 72 of the tubular string 24, such that the first shearing portion 66 may cut through the entire tubular string 24. Similarly, the second shearing portion 68 may include a second width 74 that is greater than the diameter 72 of the tubular string 24. Accordingly, when the first and second shearing portions 66, 68 are aligned with the tubular string 24 and are directed toward one another, the tubular string 24 may be substantially or completely cut to seal the bore 25. However, in certain embodiments, the first and second shearing portions 66, 68 may not extend across an entire diameter 76 of the bore 25. For example, the bore 25 may include an annular opening 78 that surrounds the tubular string 24. Although the first and second shearing portions 66, 68 may not extend across the entire diameter 76 of the bore 25, the first and second rams 50, 52 may include non-shearing portions 80, 82, respectively, that are configured to cover portions of the bore 25 that may be left uncovered by the shearing portions 66, 68. In other embodiments, the shearing portions 66, 68 may extend across the entire diameter 76 of the bore 25. In any case, during blowout conditions, the first and second rams 50, 52 may be moved along the second axis 32 toward one another to seal the bore 25. To completely seal the bore 25, the first and second rams 50, 52 may cut through the tubular string 24.

In some embodiments, the shearing portions 66, 68 may include the same or different geometries. For example, as shown in the illustrated embodiment of FIG. 3, the first shearing portion 66 may include a substantially linear (e.g., a generally straight line, tangential to a curvature of the tubular string 24, or acutely angled) geometry. The second shearing portion 68 may include an indented geometry (e.g., two lines forming an obtuse angle with respect to a joint 83, a V shape, a U-shape, a C-shape, or acutely angled shape relative to straight line geometry of the shearing portion 66). It should be noted that in other embodiments, the first and second shearing portions 66, 68 may include the same geometries and/or any other suitable geometry for cutting the tubular string 24 and sealing the bore 25. The first and second shearing portions 66 and 68 may be parallel to one another or angled relative to one another. In some embodiments, the first shearing portion 66 and the second shearing portion 68 may be offset with respect to the axial axis 30 (see, e.g., FIGS. 4-10). For example, the first shearing portion 66 may be at a first position along the axial axis 30 such that the second shearing portion 68 may be configured to be positioned above or below (e.g., with respect to the axial axis 30) the first shearing portion 66 (e.g., the first and second shearing portions 66, 68 may not directly contact one another) when both the first and second shearing portions 66, 68 are in a second position (see, e.g., FIG. 10). In other words, when the first and second rams 50 and 52 are directed toward one another, the first and second rams 50 and 52 may axially overlap with one another along the axis 30. For example, the first and second shearing portions 66 and 68 may slide along one another, e.g., along a planar interface, such that a cutting edge of the first and second shearing portions 66 and 68 is close to or directly within the same plane. Such a configuration may enable both the first and second shearing portions 66, 68 to completely pass through the tubular string 24 when blowout conditions exist.

The tubular string 24 may be cut as the first and second shearing portions 66, 68 contact a circumference 84 (e.g., an outer surface) of the tubular string 24. As discussed above, shearing rams may include shearing portions that have a tapered surface (e.g., in the second direction 32) forming an edge that is configured to shear the tubular string 24. Unfortunately, without the disclosed embodiments, at least a portion of the tapered surface may also contact the tubular string 24, thereby spreading the shear force applied to the tubular string 24 in the axial direction 30 and increasing an amount of the input force that may ultimately be applied to shear the tubular string 24. Accordingly, in the disclosed embodiments, the first shear ram 50 and the second shear ram 52 include a ledge 100 (e.g., a first ledge, and/or a first radially extending tip or edge) and a ledge 102 (e.g., a second ledge and/or a second radially extending tip or edge), respectively, that may reduce an input force that is used to shear the tubular string 24 and increase a shear force applied to the tubular string. As discussed above, increasing the shear force that is applied to the tubular string 24 and reducing the input force used to shear the tubular string 24 may enable the BOP 40 to be disposed at greater depths with respect to the platform 12 and/or the surface 14.

As shown in the illustrated embodiment of FIG. 3, the ledge 100 may extend across the entire length 70 of the first shearing portion 66 and the ledge 102 may extend across the entire length 74 of the second shearing portion 68. In some embodiments, the first ram 50 and/or the second ram 52 may not include the non-shearing portions 80 and 82, such that the ledges 100 and 102 extend across the entire diameter 76 of the bore 25. In some embodiments, the ledges 100 and 102 may be formed in the shearing portions 66 and 68, respectively, such that the ledges 100 and 102 include the same material as the shearing portions 66 and 68 (e.g., the ledges 100 and 102 and the shearing portions 66 and 68 include a common body, and/or a continuous or one-piece component). Further, the ledges 100 and 102 may be treated (e.g., heat treated) to increase a hardness and/or wear resistance of the ledges 100 and 102 with respect to the remainder of the shearing portions 66 and 68. Increasing the hardness of the ledges 100 and 102 may further increase an amount of shear force that may be applied to the tubular string 24 to shear the tubular string 24 because the increased hardness may facilitate penetration of the tubular string 24. In other embodiments, the ledges 100 and 102 may be formed from a different material (e.g., carbides, such as tungsten carbide) than the shearing portions 66 and 68, respectively, and may be coupled to the shearing portions 66 and 68 via a weld, a shrink fit, an interference fit, and/or another suitable technique.

Figure 4:
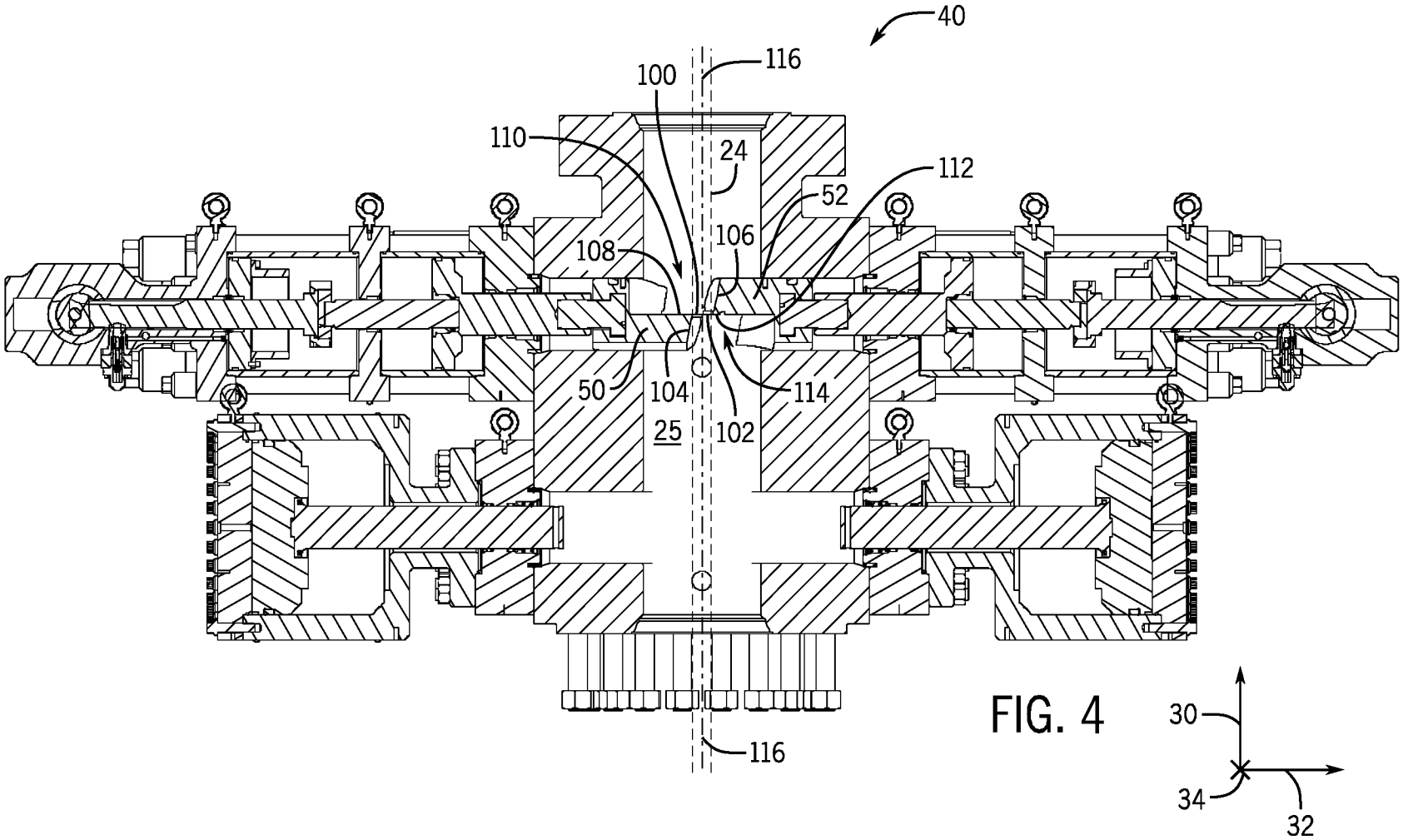
FIG. 4 is a cross-sectional side view of an embodiment of the BOP of FIG. 3 that includes shearing rams having a ledge, in accordance with an embodiment of the present disclosure.

FIG. 4 is a cross-sectional view of a portion of the BOP 40 of the BOP stack 38, illustrating the first ram 50 and the second ram 52 having the ledge 100 and the ledge 102, respectively, which may reduce an input force used to shear the tubular string 24 because of the increased shear force applied to the tubular string by the ledges 100 and 102. As shown in the illustrated embodiment of FIG. 4, the first ram 50 may include a tapered surface 104 (e.g., a first tapered surface) and the second ram 52 may include a tapered surface 106 (e.g., a second tapered surface). The tapered surface 104 may form an edge 108 (e.g., a first edge) on an end 110 of the tapered surface 104. Similarly, the tapered surface 106 may form an edge 112 (e.g., a second edge) on an end 114 of the tapered surface 106. In some embodiments, the ledge 100 may be positioned at the end 108 of the tapered surface 104 and the ledge 102 may be positioned at the end 110 of the tapered surface 106. Additionally, the ledges 100 and 102 may extend from the edges 106 and 110 along the second axis 32 (e.g., protrude radially toward a central axis 116). Therefore, the ledges 100 and 102 are configured to contact the tubular string 24 before the edges 108 and 112 of the tapered surfaces 104 and 106, respectively.

Figure 5:
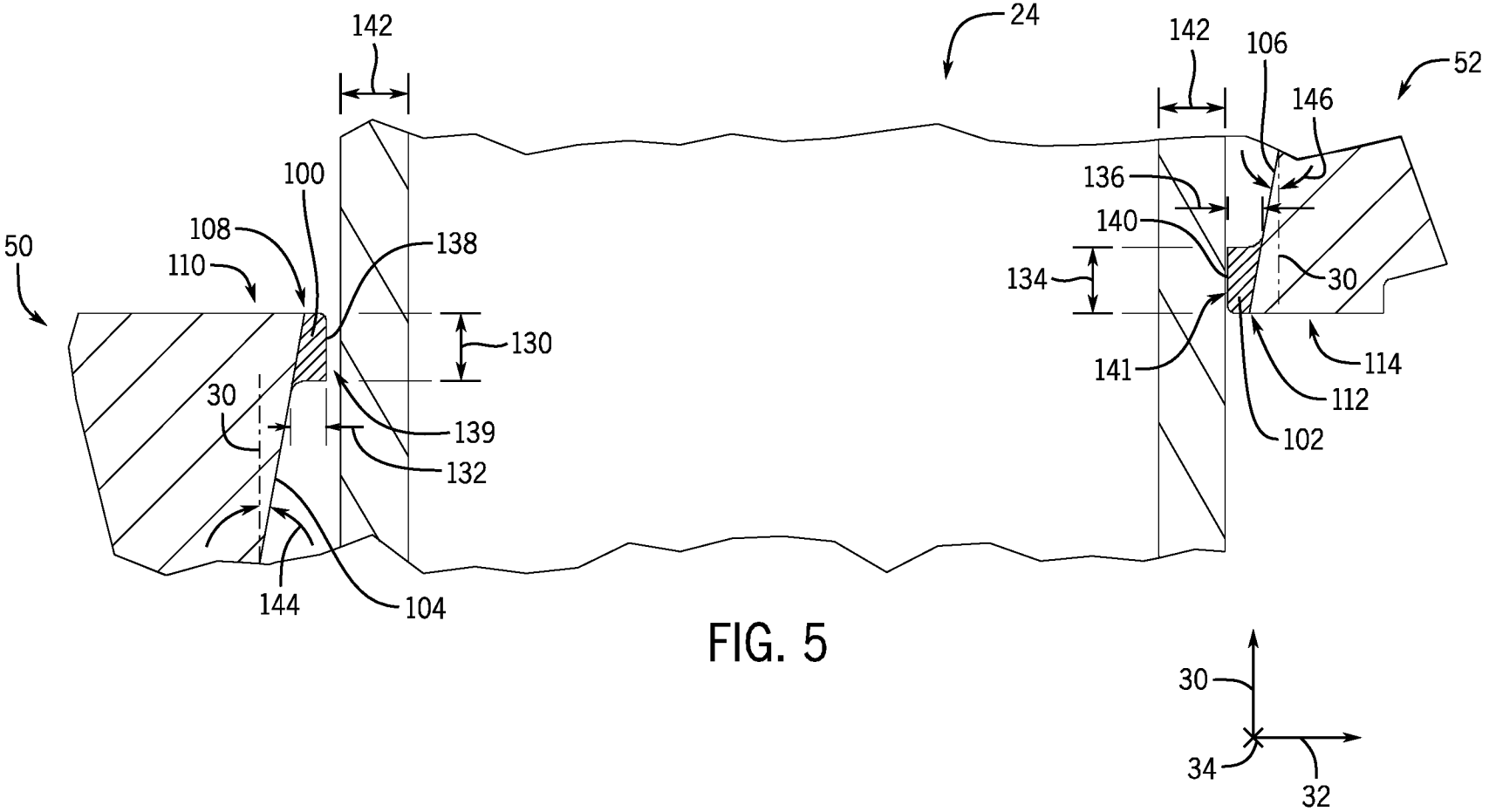
FIG. 5 is an expanded cross-sectional side view of an embodiment of the BOP of FIG. 3 illustrating the ledges, in accordance with an embodiment of the present disclosure.

The ledges 100 and 102 may include a relatively small thickness, such that a shear force for shearing the tubular string 24 is increased. Further, as discussed above, the ledges 100 and 102 may include an increased hardness to facilitate shearing of the tubular string 24. For example, FIG. 5 is an expanded section view of the ledges 100 and 102 of the first and second rams 50 and 52, respectively. As shown in the illustrated embodiment of FIG. 5, the ledge 100 may include a thickness 130 and extend a distance 132 (i.e., radial offset or gap) from the tapered surface 104. Similarly, the ledge 102 may include a thickness 134 and extend a distance 136 (i.e., radial offset or gap) from the tapered surface 106. In some embodiments, the thicknesses 130 and 134 may be substantially equal to one another (e.g., within 10%, within 5%, or within 1% of one another). For example, the thicknesses 130 and 134 may be between 1/16 inches and 3/4 inches (between 0.159 centimeters (cm) and 1.91 cm), between 1/8 inches and 1/2 inches (between 0.318 cm and 1.27 cm), or between 1/8 inches and 3/8 inches (between 0.318 cm and 0.953 cm).

Further, in some embodiments, the distances 132 and 136 may be substantially equal to one another (e.g., within 10%, within 5%, or within 1% of one another). The distances 132 and 136 may be between 1/16 inches and 3/4 inches (between 0.159 centimeters (cm) and 1.91 cm), between 1/8 inches and 1/2 inches (between 0.318 cm and 1.27 cm), or between 1/8 inches and 3/8 inches (between 0.318 cm and 0.953 cm). As shown in the illustrated embodiment, the distances 132 and 136 may not be uniform throughout the entire thicknesses 130 and 134, respectively, because of the tapered surfaces 104 and 106. The distances 132 and 136 may not be uniform, such that the ledges 100 and 102 include substantially parallel edges 138 and 140 (e.g., edges that are substantially parallel to the axial direction 30). Forming the substantially parallel edges 138 and 140 may ultimately reduce an amount of surface area of the rams 50 and 52 that contact the tubular string 24, thereby applying an increased amount of force to the tubular string 24 upon shearing. For example, the ledges 100 and 102 may each include a surface area 139 and 141, respectively, which may increase the shear force applied to the tubular string 24. In some embodiments, the surface areas 139 and 141 may be between 0.0625 square inches and 4.5 square inches (between 0.403 square cm and 29.03 square cm), between 0.125 square inches and 3 square inches (between 0.806 square cm and 19.35 square cm), or between 0.125 square inches and 2.25 square inches (e.g., between 0.806 square cm and 14.52 square cm).

As discussed above, the ledges 100 and 102 may include an increased hardness and/or wear resistance when compared to the tapered surfaces 104 and 106 of the rams 50 and 52. For example, in some embodiments, the ledges 100 and 102 may include a hardness between 50 and 65, between 52 and 60, or between 54 and 56, as measured on the Rockwell hardness "C" (e.g., HRC) scale. In other embodiments, the hardness of the ledges 100 and 102 may be at least 50, at least 55, or at least 60, as measured on the HRC scale. Additionally, the tapered surfaces 104 and 106 may include a hardness between 35 and 55, between 48 and 53, or approximately (e.g., within 10% of, within 5% of, or within 1% of) 50, as measured on the HRC scale. In other embodiments, the hardness of the tapered surfaces 104 and 106 may be at least 45, at least 48, or at least 50, as measured on the HRC scale. As discussed above, in some embodiments, the ledges 100 and 102 include the same material as the tapered surfaces 104 and 106, but are treated in order to increase the hardness and/or wear resistance when compared to the tapered surfaces 104 and 106. For example, the ledges 100 and 102 may be heat treated. As used herein, heat treatment is a process of applying thermal energy to a material in order to change physical and/or chemical properties of the material, such as hardness, strength, ductility, elasticity, wear resistance among others. Increasing the hardness and/or wear resistance of the ledges 100 and 102 enables the shearing rams 50 and 52 to shear the tubular string 24 with increased shear force and reduced input force. Accordingly, the BOP 40 may be configured to shear the tubular string 24 at increased wellbore pressures (e.g., at greater depths from the platform 12 and/or the surface 14) and/or to shear the tubular string 24 having an increased wall thickness 142 (e.g., 1 inch thickness or greater). Accordingly, the ledge 100 and 102 may improve operation of the BOP 40.

In some embodiments, the thickness 130 and 134 of the ledges 100 and 102, respectively, are selected based on the wall thickness 142 of the tubular string 24. For example, a ratio between the thickness 130 and/or 134 of the ledges 100 and/or 102 and the wall thickness 142 of the tubular string 24 may be between 0.01 and 1, between 0.06 and 0.75, between 0.1 and 0.6, or between 0.15 and 0.5. Further, as shown in the illustrated embodiment of FIG. 5, the tapered surface 104 may form an angle 144 (e.g., a first angle) with the axis 30 and the tapered surface 106 may form an angle 146 (e.g., a second angle) with the axis 30. In some embodiments, the angles 144 and 146 are between 5 degrees and 60 degrees, between 10 degrees and 45 degrees, or between 20 degrees and 40 degrees. As such, the distances 132 and 136 in which the ledges 100 and 102 extend from the tapered surfaces 104 and 106, respectively, may decrease toward the ends 110 and 114 of the tapered surfaces 104 and 106.

Figure 6:
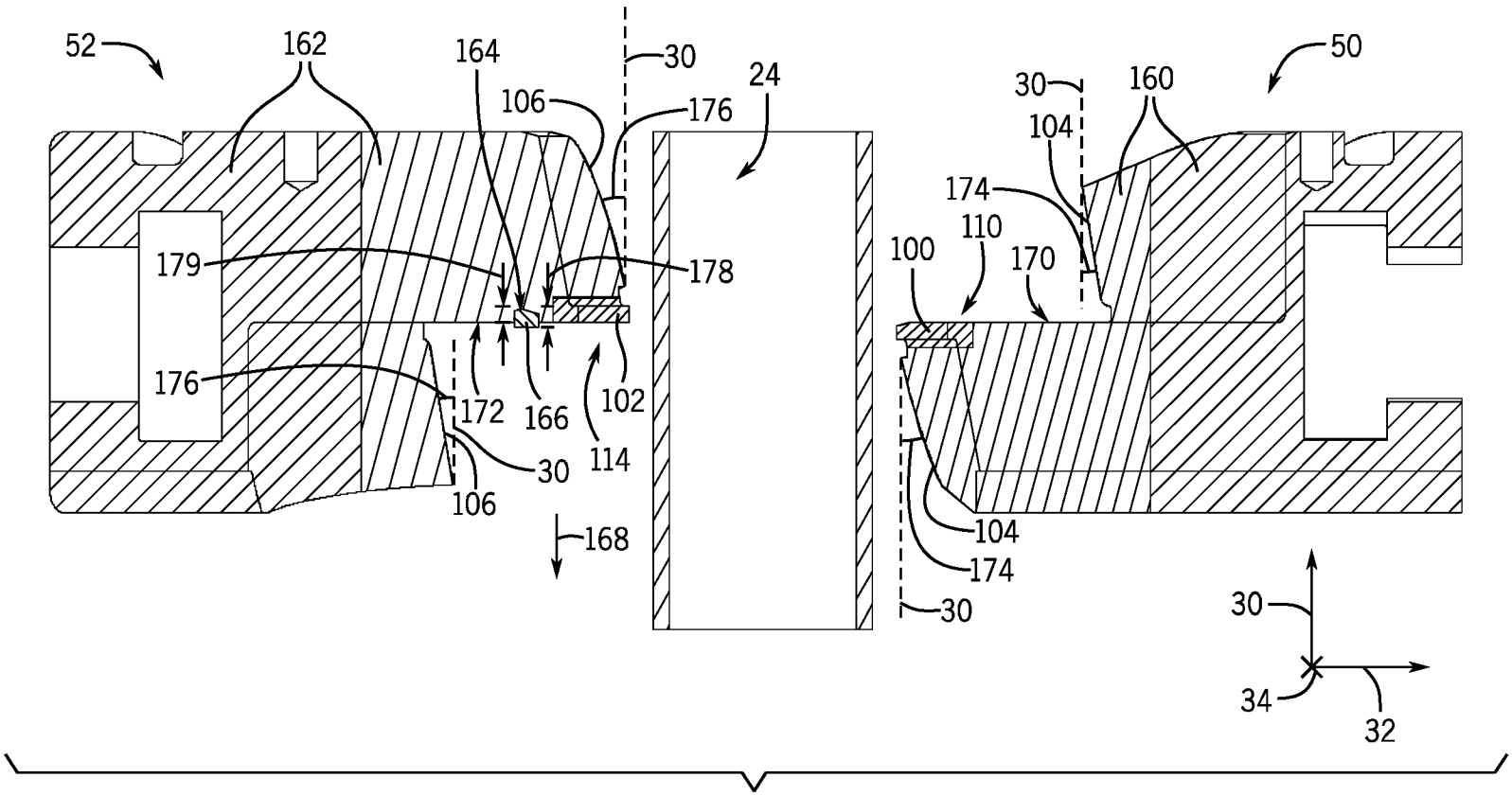
FIG. 6 is a cross-sectional side view of an embodiment of the BOP of FIG. 3 illustrating the shearing rams in a default position, in accordance with an embodiment of the present disclosure.

Further still, the ram 50 may include a body portion 160 (e.g., a first body portion) and the ram 52 may include a body portion 162 (e.g., a second body portion), as shown in FIG. 6. In some embodiments, the body portions 160 and 162 include a hardness and/or wear resistance different from the ledges 100 and 102 and/or the tapered surfaces 104 and 106. For example, the hardness and/or wear resistance of the body portions 160 and 162 may be between 25 and 40, between 26 and 35, or between 28 and 32, as measured on the HRC scale. In other embodiments the hardness of the body portions 160 and 162 may be below 40, below 35, or below 30, as measured on the HRC scale. Accordingly, the hardness and/or wear resistance of the rams 50 and 52 may decrease moving radially outward along the second axis 32 and away from the tubular string 24. As such, a hardness and/or wear resistance gradient is formed within the rams 50 and 52, such that the rams 50 and 52 have the greatest hardness and/or wear resistance at the ledges 100 and 102, which ultimately contact the tubular string 24 to shear the tubular string 24. However, in other embodiments, the rams 50 and 52 may include a uniform hardness and/or wear resistance throughout the ledges 100 and 102, the tapered surfaces 104 and 106, and/or the body portions 160 and 162 along the second direction 32.

The body portions 160 and 162 may include the tapered surfaces 104 and 106, respectively, despite the different hardness and/or wear resistance levels of the body portions 160 and 162 and the tapered surfaces 104. Further, the body portion 160, the tapered surface 104, and the ledge 100 of the ram 50 may be formed from a common body and/or material. In other words, the body portion 160, the tapered surface 104, and the ledge 100 may be a single, continuous, unitary piece that includes varying degrees of hardness and/or wear resistance. The varying hardness and/or wear resistance throughout the common body of the ram 50 may be achieved through a treatment process (e.g., heat treatment, chemical treatment, layering of materials, among others). Similarly, the body portion 162, the tapered surface 106, and the ledge 102 of the ram 52 may be formed from a common body and/or material. In other words, the body portion 162, the tapered surface 106, and the ledge 102 may be a single, continuous, unitary piece that includes varying degrees of hardness and/or wear resistance. The varying hardness and/or wear resistance throughout the common body of the ram 52 may be achieved through a treatment process (e.g., heat treatment, chemical treatment, layering of materials, among others).

Additionally, as shown in the illustrated embodiment of FIG. 6, the ram 52 has a recess 164 that receives a sealing member 166 (e.g., a sealing shim, a sealing material, a sealing inlay, a biasing shim, a biasing material, a biasing inlay, among others) to enhance a seal between the rams 50 and 52 upon shearing the tubular string 24. For example, the sealing member 166 may be biased axially downward, as shown by arrow 168. As such, the sealing member 166 on the ram 52 may apply a force on a surface 170 of the ram 50 when the rams 50 and 52 overlap with one another with respect to the axis 32, which the rams 50 and 52 move along toward one another (see, e.g., FIG. 10). While the illustrated embodiment of FIG. 6 shows the sealing member 166 disposed in the recess 164 on a surface 172 of the ram 52, it should be noted that in other embodiments the sealing member 166 may be disposed in the surface 170 of the ram 50 and apply a force on the surface 172 of the ram 52.

In some embodiments, the sealing member 166 may include a resilient material (e.g., nylon, polytetrafluoroethylene, polyetheretherketone, rubber, another suitable polymer or elastomeric material, or a combination thereof) or a layered material (e.g., a material having a polymer layer, an elastomer layer, a metal layer, a fabric layer, another suitable layer and/or any combination thereof) that compresses when the rams 50 and 52 overlap with one another with respect to the axis 32, which the rams 50 and 52 move along toward one another. Further, the sealing member 166 may include a cap that includes a pressure and/or temperature-resistant material (e.g., a metallic cap) that is disposed over the resilient material (e.g., a polymer material or elastomeric material). The force applied by the sealing member 166 enhances a seal between the rams 50 and 52 and reduces and/or eliminates gaps (e.g., axial gaps) that may be formed between the rams 50 and 52. In some cases, the sealing member 166 may enhance an operating life of the rams 50 and 52 by improving the seal between the rams 50 and 52 and reducing a fluid pressure exerted on the rams 50 and 52 within a gap between the rams 50 and 52 (e.g., between the surfaces 170 and 172).

In some embodiments, the sealing member 166 extends along the entire second width 74 of the ram 52. Therefore, the sealing member 166 contacts the surface 170 over the entire first width 70 of the ram 50 to form the seal between the rams 50 and 52. As shown in the illustrated embodiment of FIG. 6, the sealing member 166 has a thickness 178, which may be larger than a depth 179 of the recess 164. Accordingly, the sealing member 166 may compress and apply the force against the surface 170 when the sealing member 166 overlaps with the surface 170. In other embodiments, the sealing member 166 may include any suitable thickness 178 that enhances the seal between the rams 50 and 52. Additionally, in some embodiments, the sealing member 166 may be secured in the recess 164 via a fastener (e.g., a screw, a bolt, a clamp, or another suitable securement device). In other embodiments, the sealing member 166 may be secured within the recess 164 via an interference fit. In still further embodiments, the sealing member 166 may be secured in the recess 164 by an adhesive, a weld, and/or another suitable technique that may secure the sealing member 166 within the recess 164.

Further, the tapered surfaces 104 and 106 of the rams 50 and 52 may enhance the seal formed by the rams 50 and 52. For example, the tapered surfaces 104 and 106 may engage one another to drive the surface 170 of the ram 50 toward the surface 172 of the ram 52. As the tapered surfaces 104 and 106 engage one another, angles 174 and 176 of the tapered surfaces 104 and 106 wedge the rams 50 and 52 against one another, thereby driving the surfaces 170 and 172 toward one another to improve the seal (e.g., including the sealing member 166) between the rams 50 and 52. In some embodiments, the angles 174 and 176 of the tapered surfaces may be between 10 degrees and 85 degrees, between 20 degrees and 60 degrees, or between 25 degrees and 50 degrees, with respect to the axis 30. In other embodiments, the angles 174 and 176 may be any suitable angle to wedge the rams 50 and 52 against one another to direct the surfaces 170 and 172 toward one another. In any case, the tapered surfaces 104 and 106 may also enhance the seal (e.g., including the sealing member 166) and improve an operating life of the rams 50 and 52.

Figure 7:
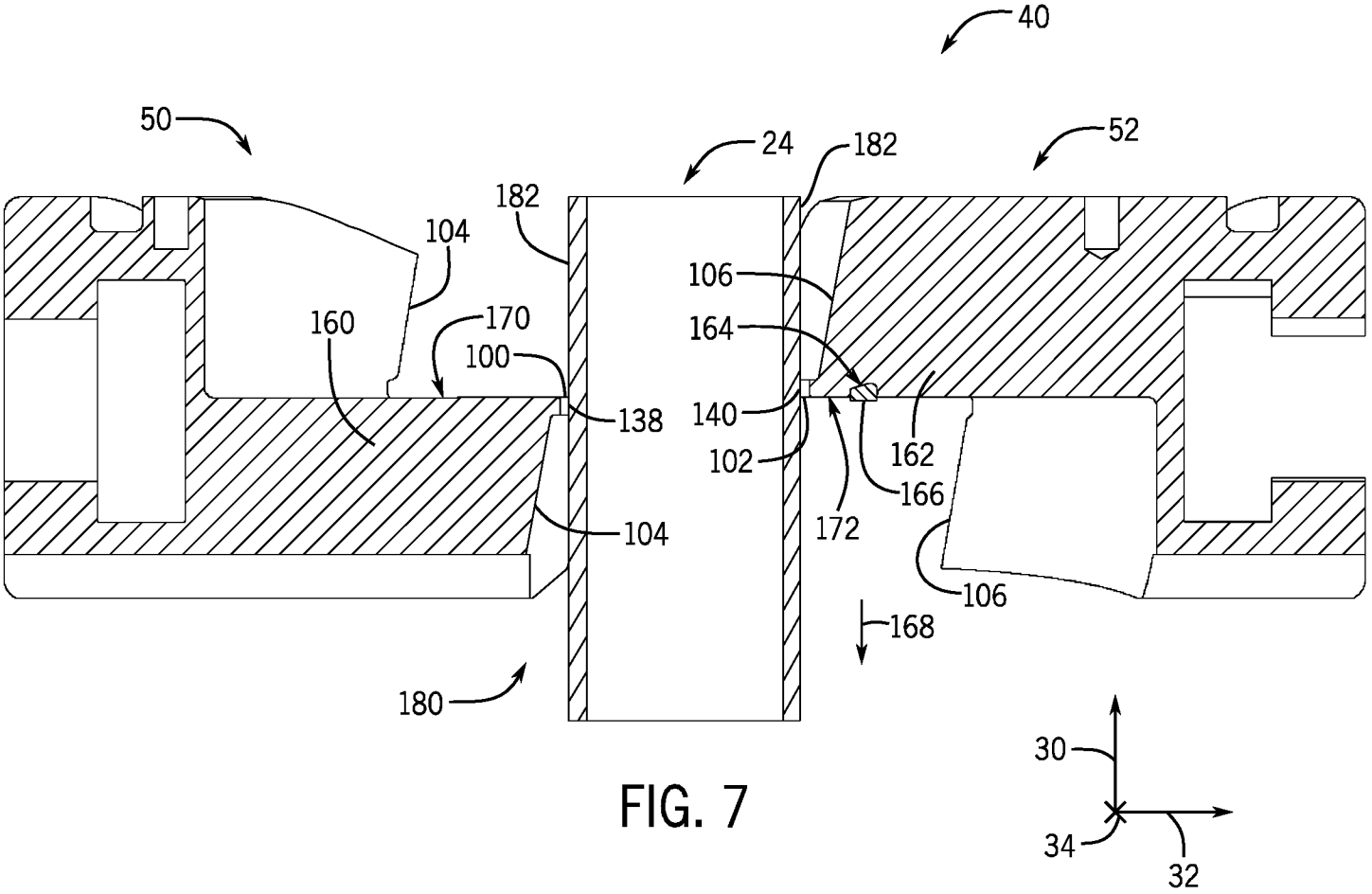
FIG. 7 is a cross-sectional side view of an embodiment of the BOP of FIG. 3 illustrating the shearing rams in a first position of a shearing sequence, in accordance with an embodiment of the present disclosure.

As discussed above, the rams 50 and 52 may shear the tubular string 24 upon actuation of the rams 50 and 52 (e.g., via the accumulators 45 and the actuators 42). For example, FIG. 7 is a section view of an embodiment of the rams 50 and 52 in a first position 180 during the shearing process. For example, the BOP 40 may be actuated by the controller 46 to shear the tubular string 24 (e.g., when a pressure exceeds the threshold and/or upon operator instruction). As shown in the illustrated embodiment of FIG. 7, the ledge 100 of the first ram 50 and the ledge 102 of the second ram 52 may contact an outer surface 182 of the tubular string 24. The first ram 50 and the second ram 52 may be moved from the default position 54 (see, e.g., FIGS. 3 and 6) to the first position 180 by actuating the rams 50 and 52 radially inward along the second axis 32 toward the tubular string 24 and toward one another.

In some embodiments, the substantially parallel edges 138 and 140 of the first ledge 100 and the second ledge 102, respectively, are substantially flush with the outer surface 182 of the tubular string 24. As used herein, substantially flush refers to a majority of the substantially parallel edges 138 and 140 is in physical contact the outer surface 182. As discussed above, reducing an amount of surface area of the rams 50 and 52 that is in contact with the tubular string 24 increases an amount of shear force applied to the tubular string 24 and reduces an amount of input force that is utilized to shear the tubular string 24.

Figure 8:
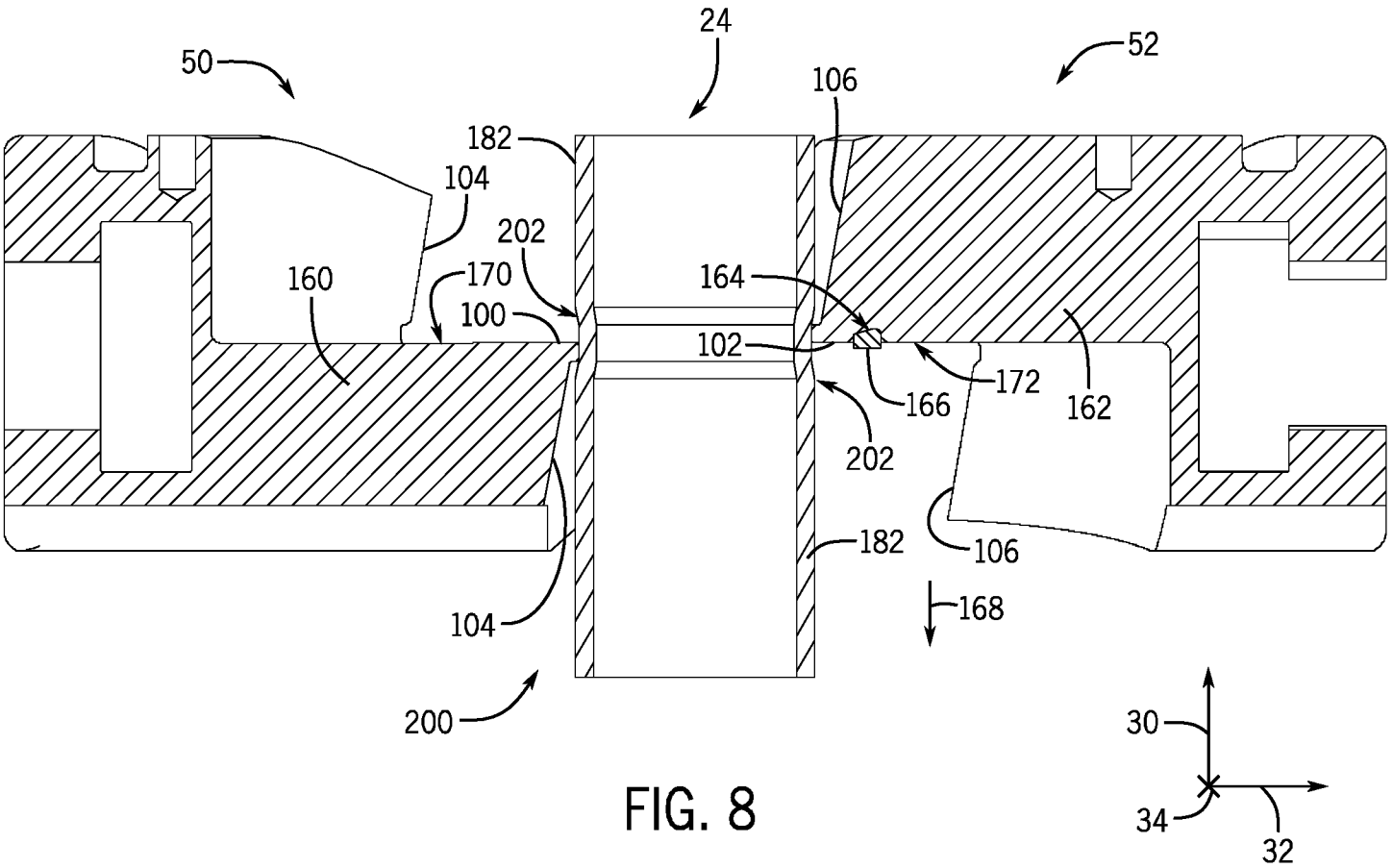
FIG. 8 is a cross-sectional side view of an embodiment of the BOP of FIG. 3 illustrating the shearing rams in a second position of the shearing sequence, in accordance with an embodiment of the present disclosure.

As the rams 50 and 52 continue to move radially inward along the second axis 32 toward one another, the tubular string 24 may begin to compress before the ledges 100 and 102 actually puncture (e.g., penetrate and/or otherwise breach) the tubular string 24. For example, FIG. 8 is a section view of the rams 50 and 52 in a second position 200 as the rams 50 and 52 move radially inward along the second axis 32 during the shearing process. As shown in the illustrated embodiment of FIG. 8, the tubular string 24 compresses inward along the second axis 32 (e.g., radially inward) as the ledges 100 and 102 move along the second axis 32 toward the tubular string 24. The ledges 100 and 102 may form an indentation 202 in the tubular string 24 because of the force applied by the ledges 100 and 102 on the outer surface 182 of the tubular string 24. Eventually, as the rams 50 and 52 continue to move toward one another along the second axis 32, the shear force of the ledges 100 and 102 applied to the tubular string 24 may puncture the tubular string 24.

Figure 9:
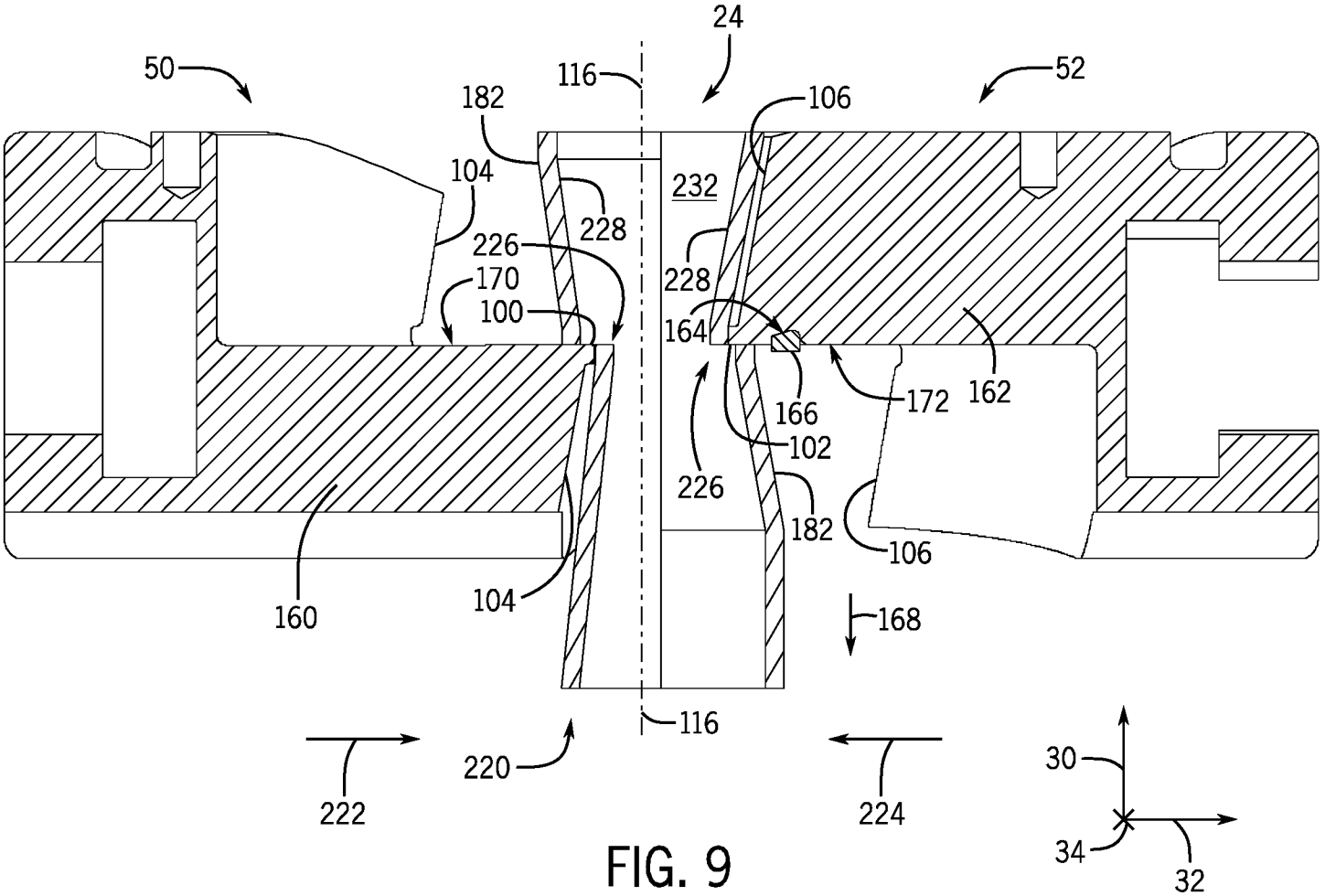
FIG. 9 is a cross-sectional side view of an embodiment of the BOP of FIG. 3 illustrating the shearing rams in a third position of the shearing sequence, in accordance with an embodiment of the present disclosure.

For example, FIG. 9 is a section view of the rams 50 and 52 in a third position 220. As shown in the illustrated embodiment of FIG. 9, the first ram 50 and the second ram 52 apply opposing forces 222 and 224, respectively, on the tubular string 24. The opposing forces 222 and 224 may lead to openings 226 in the surface 182 of the tubular string 24 as the rams 50 and 52 each move inward toward the tubular string 24 and toward one another. In some embodiments, the rams 50 and 52 distort the tubular string 24 and cause the tubular string 24 to collapse inward, such that an inner surface 228 of the tubular string 24 is directed toward the central axis 116 defining a bore 232 of the tubular string 24. As the rams 50 and 52 continue to move radially inward along the second axis 32 toward one another, the openings 226 in the tubular string 24 may increase circumferentially until the tubular string 24 is ultimately sheared into a first portion 250 and a second portion 252.

Figure 10:
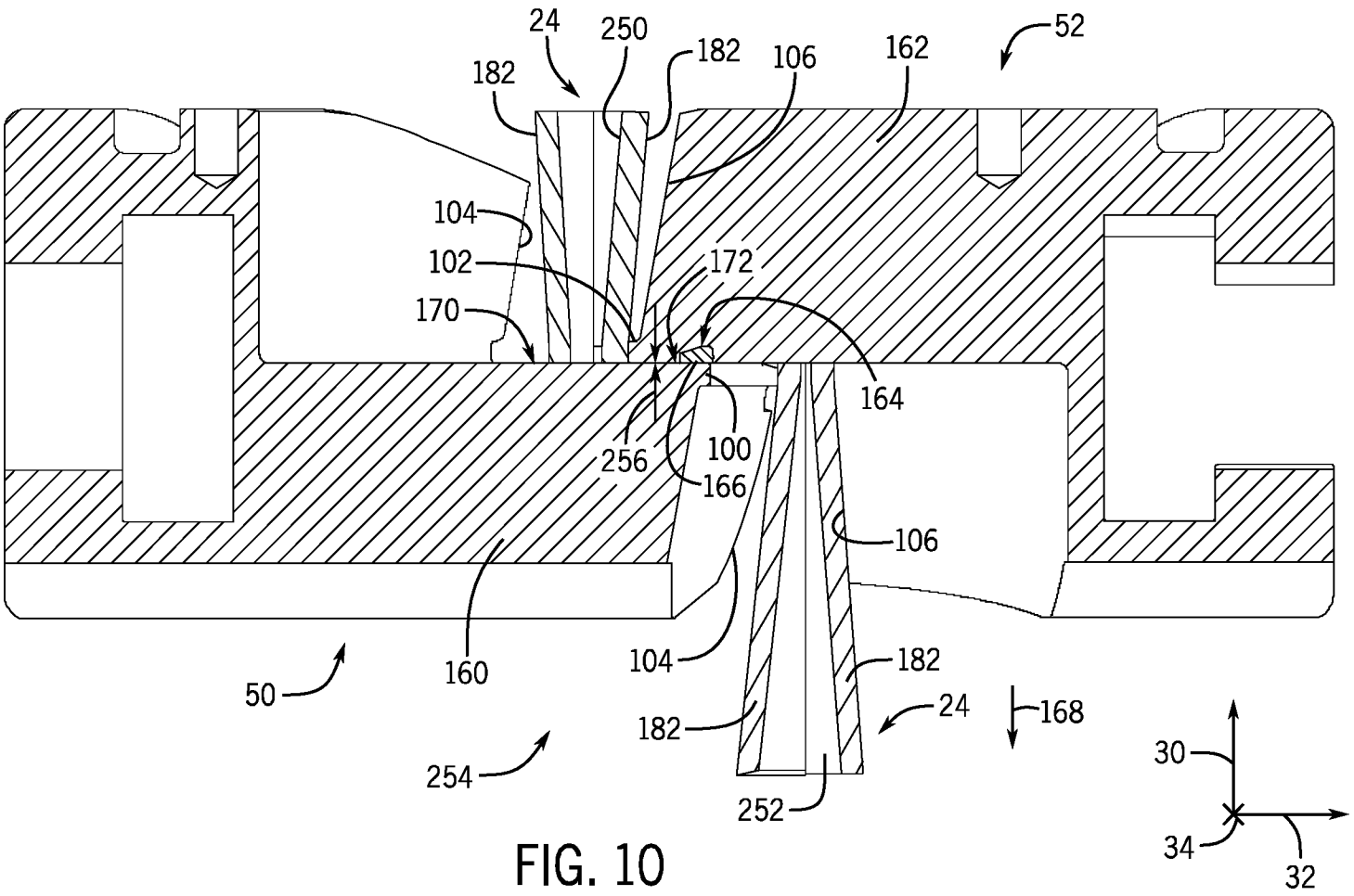
FIG. 10 is a cross-sectional side view of an embodiment of the BOP of FIG. 3 illustrating the shearing rams in a fourth position of the shearing sequence, in accordance with an embodiment of the present disclosure.

For example, FIG. 10 is a section view of the rams 50 and 52 in a fourth position 254. When the rams 50 and 52 are in the fourth position 254, the tubular string 24 may be completely sheared (e.g., separated into the first portion 250 and the second portion 252) and the bore 25 through the BOP is sealed. As shown in the illustrated embodiment of FIG. 10, the first ram 50 and the second ram 52 axially overlap with one another (e.g., along the axis 30) and may be separated by a distance 256 along the axial direction 30. In some embodiments, the distance 256 may be less than 1/16 of one inch (less than 0.159 cm), less than 1/8 of one inch (less than 0.318 cm), or less than 1/2 of one inch (less than 1.27 cm). In other embodiments, the first ram 50 and the second ram 52 may be flush against one another when in the fourth position 254. For example, the rams 50 and 52 may include surfaces having a low friction material, a wear resistant material, and/or a polished finish to enable the rams 50 and 52 to slide against one another at a planar interface with reduced friction. In any case, the first ram 50 and the second ram 52 may be positioned, such that the ledges 100 and 102 may shear the tubular string 24 in substantially a single plane (e.g., within 80%, within 85%, within 90%, within 95%, or within 99% of a single plane formed by the ledge). In other words, the shear force applied to the tubular string 24 by the rams 50 and 52 may be substantially within the single plane. Positioning the first ram 50 and the second ram 52 relatively close to one another along the axial direction 30 may increase an amount of shear force applied to the tubular string 24, because the shear force is concentrated within the substantially single plane.

As discussed above, the sealing member 166 may apply a force 258 to the surface 170 of the ram 50 and/or the surface 172 of the ram 52. As such, the sealing member 166 may eliminate and/or reduce gaps that form between the rams 50 and 52, thereby enhancing a seal formed when the rams 50 and 52 overlap with respect to the axis 32, which the rams 50 and 52 move along toward one another. In some cases, gaps formed between the rams 50 and 52 may reduce an operating life of the rams 50 and/or 52 because of excess pressure applied by fluid within the gaps. The fluid pressure applied to the rams 50 and 52 may increase the distance 256 between the rams 50 and 52, which may result in an insufficient seal when the rams 50 and 52 overlap. Accordingly, the sealing member 166 may block fluid from flowing between the rams 50 and 52, such that fluid pressure may not increase the distance 256 between the rams 50 and 52. Utilizing the sealing member 166 may increase an operating life of the rams 50 and 52, as well as enable the rams 50 and 52 to operate in high pressure and/or high temperature environments because of the enhanced seal.

Figure 11:
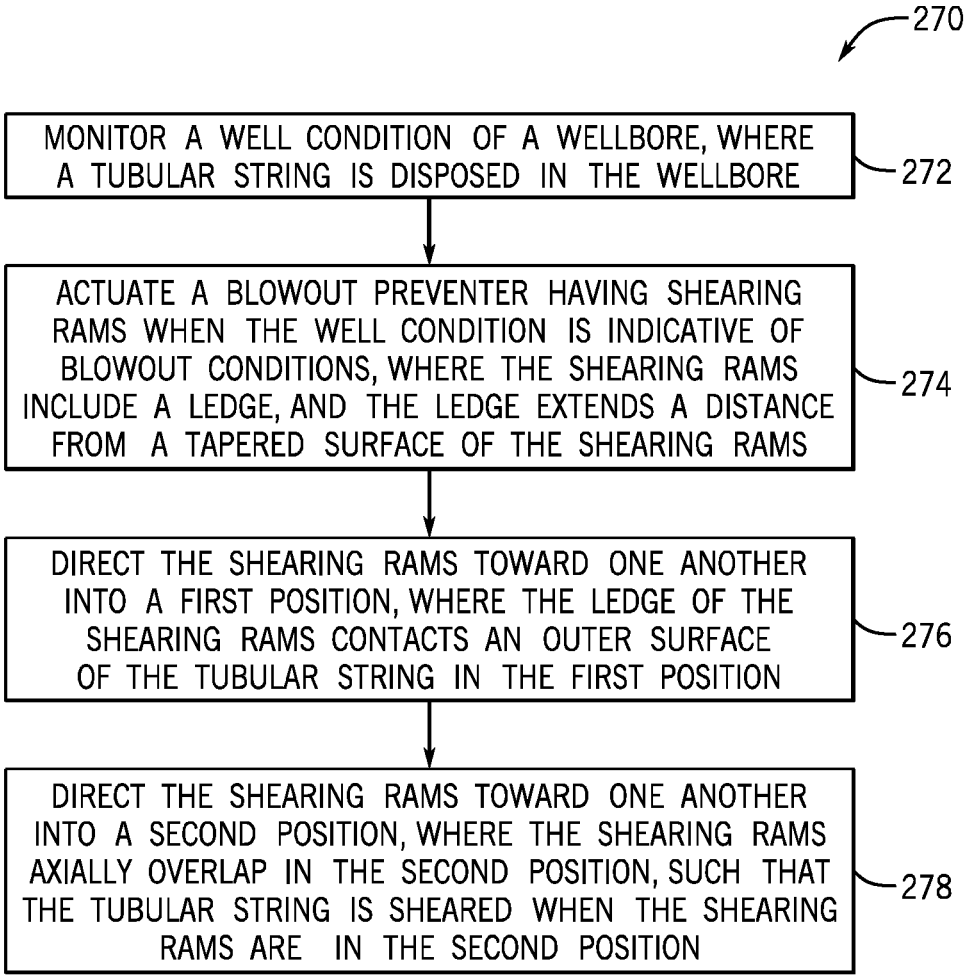
FIG. 11 is a flow chart of an embodiment of the shearing sequence that may be utilized to shear a tubular string with the shearing rams having the ledge, in accordance with an embodiment of the present disclosure.

FIG. 11 is a flow chart of an embodiment of a process 270 of shearing the tubular string 24 using the shearing rams 50 and 52 having the ledges 100 and 102, respectively. For example, at block 272, an operator and/or the controller 46 may monitor conditions in the wellbore 26 to determine whether such conditions are suitable for sealing the BOP 40 and shearing the tubular string 24. As discussed above, the controller 46 may monitor the pressure in the wellbore 26 and actuate the BOP 40 when the pressure in the wellbore 26 exceeds a threshold pressure (e.g., a threshold pressure may be indicative of a kick and/or blowout conditions or near blowout conditions). Accordingly, at block 274, the BOP 40 may be actuated to direct the rams 50 and 52 along the second axis 32 toward one another when the pressure in the wellbore 26 exceeds the threshold pressure. As discussed above, the rams 50 and 52 include the ledges 100 and 102, such that a shearing force applied to the tubular string 24 to shear the tubular string 24 is increased.

At block 276, the rams 50 and 52 are directed toward one another to the first position 180 where the ledges 100 and 102 contact the outer surface 182 of the tubular string 24. In some embodiments, the ledges 100 and 102 may include the substantially parallel edges 138 and 140, which may be substantially parallel to the outer surface 182 of the tubular string 24. Accordingly, the ledges 100 and 102 may be flush with the outer surface 182 of the tubular string 24 when in the first position 180 to reduce an amount of surface area of the rams 50 and 52 in contact with the tubular string 24. At block 278, the rams 50 and 52 may continue to be directed toward one another along the second axis 32 to the fourth position 254, where the first ram 50 and the second ram 52 may axially overlap (see, e.g., FIG. 11) and the tubular string 24 is separated into the first portion 250 and the second portion 252. Accordingly, the tubular string 24 may be completely sheared and the bore 25 of the BOP 40 sealed by applying an increased shear force to the tubular string 24.

While the present disclosure may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is to cover all modifications, equivalents, and alternatives falling within the spirit and scope of the present disclosure as defined by the following appended claims.

The invention claimed is:

1. A system, comprising:

a first shearing ram configured to mount in a blowout preventer, wherein the blowout preventer comprises a bore extending therethrough along a first axis, wherein the first shearing ram comprises:

a body portion configured to move along a second axis, transverse to the first axis, through the bore; and a sealing member disposed in a first surface of the body portion, wherein the sealing member is biased away from the first surface in a direction along the first axis, such that the sealing member is configured to engage a second surface of a second shearing ram when the first shearing ram and the second shearing ram overlap with one another with respect to the second axis, wherein the body portion comprises a first tapered surface positioned on a first side of the first surface with respect to the first axis and an additional tapered surface positioned on a second side of the first surface with respect to the first axis, wherein the first tapered surface is spaced apart from the first surface and extends longitudinally at a first angle with respect to the first axis such that the first tapered surface is configured to extend radially outwardly from the first surface away from the bore, wherein the additional tapered surface is spaced apart from the first surface and extends longitudinally at a respective angle with respect to the first axis such that the additional tapered surface is configured to extend radially inwardly from the first surface toward the bore.

2. The system of claim 1, wherein the first angle for the first tapered surface and the respective angle for the additional tapered surface are between 25 and 50 degrees with respect to the first axis.

3. The system of claim 1, wherein the sealing member comprises a sealing shim or a biasing shim.

4. The system of claim 1, wherein the sealing member comprises a resilient material.

5. The system of claim 1, wherein the sealing member is disposed in a recess of the first surface of the first shearing ram.

6. The system of claim 5, wherein the sealing member comprises a thickness greater than a depth of the recess.

7. The system of claim 1, wherein the sealing member extends along an entire width of the first shearing ram, wherein the entire width of the first shearing ram extends along a third axis transverse to the first axis and the second axis.

8. The system of claim 1, comprising the blowout preventer, wherein the blowout preventer comprises one or more actuators configured to move the first shearing ram and the second shearing ram toward one another to shear a tubular disposed in the bore of the blowout preventer, and the first shearing ram and the second shearing ram are configured to seal the bore of the blowout preventer when the first shearing ram and the second shearing ram overlap with one another with respect to the second axis.

9. The system of claim 1, comprising the second shearing ram configured to mount in the blowout preventer, wherein the second shearing ram comprises a second tapered surface spaced apart from the second surface and extending longitudinally at a second angle with respect to the first axis such that the second tapered surface is configured to extend radially inwardly from the second surface toward the bore.

10. The system of claim 9, wherein the second tapered surface is positioned on a respective first side of the second surface with respect to the first axis, wherein the second shearing ram comprises a respective additional tapered surface positioned on a respective second side of the second surface with respect to the first axis, wherein the respective additional tapered surface of the second shearing ram is spaced apart from the second surface and extends longitudinally at a respective angle with respect to the first axis such that the respective additional tapered surface of the second shearing ram is configured to extend radially outwardly from the second surface away from the bore, wherein the first tapered surface of the first shearing ram is aligned with the second tapered surface of the second shearing ram along the first axis, and wherein the additional tapered surface of the first shearing ram is aligned with the respective additional tapered surface of the second shearing ram along the first axis.

11. A blowout preventer system, comprising:

a body surrounding a bore extending along a first axis, wherein the bore is configured to enable fluid flow between a wellhead and a drilling riser;

a first ram disposed adjacent a first portion of the body, wherein the first ram is coupled to a first actuator; and a second ram disposed adjacent to a second portion opposite the first portion of the body, wherein the second ram is coupled to a second actuator;

wherein the first ram comprises:

a body portion configured to move along a second axis, transverse to the first axis; and a sealing member disposed in a first surface of the body portion, wherein the sealing member is configured to engage a second surface of the second ram when the first ram and the second ram overlap with one another with respect to the second axis, wherein the body portion comprises a first tapered surface spaced apart from the first surface and extending longitudinally at a first angle with respect to the first axis such that the first tapered surface is configured to extend radially outwardly from the first surface away from the bore, wherein the second ram comprises a second tapered surface spaced apart from the second surface and extending longitudinally at a second angle with respect to the first axis such that the second tapered surface is configured to extend radially inwardly from the second surface toward the bore, wherein the first tapered surface comprises a first geometry that corresponds to a second geometry of the second tapered surface, and wherein the first tapered surface is aligned with the second tapered surface along the first axis.

12. The blowout preventer system of claim 11, wherein the first angle, the second angle, or both the first angle and the second angle are between 25 and 50 degrees with respect to the first axis.

13. The blowout preventer system of claim 11, wherein the sealing member comprises a sealing shim or a biasing shim.

14. The blowout preventer system of claim 11, wherein the sealing member extends along an entire width of the first shearing ram, wherein the entire width of the first shearing ram extends along a third axis transverse to the first axis and the second axis.

15. The blowout preventer system of claim 11, wherein the sealing member comprises a resilient material.

16. A blowout preventer system, comprising:

a body surrounding a bore extending along a first axis, wherein the bore is configured to enable fluid flow between a wellhead and a drilling riser;

a first ram coupled to a first actuator; and a second ram coupled to a second actuator, wherein the first ram comprises:

a first body portion comprising a first tapered surface spaced apart from a first surface of the first body portion and extending longitudinally at a first angle with respect to the first axis such that the first tapered surface is configured to extend radially outwardly from the first surface away from the bore, wherein the first body portion is configured to move along a second axis, transverse to the first axis; and a sealing member disposed in the first surface of the body portion, wherein the sealing member is biased away from the first surface in a direction along the first axis; and wherein the second ram comprises:

a second body portion comprising a second tapered surface spaced apart from a second surface of the second body portion and extending longitudinally at a second angle with respect to the first axis such that the second tapered surface is configured to extend radially inwardly from the second surface toward the bore, wherein the second body portion is configured to move along the second axis, wherein the first tapered surface comprises a first geometry that corresponds to a second geometry of the second tapered surface, and wherein the sealing member of the first ram is configured to engage the second surface of the second ram when the first ram and the second ram overlap with one another with respect to the second axis.

17. The blowout preventer system of claim 16, wherein the first angle and the second angle are between 25 and 50 degrees with respect to the first axis.

18. The blowout preventer system of claim 16, wherein the sealing member comprises a sealing shim, a biasing shim, or another suitable sealing component.

19. The blowout preventer system of claim 16, wherein the sealing member comprises a resilient material.

20. The blowout preventer system of claim 16, wherein the first tapered surface is aligned with the second tapered surface along the first axis.

* * * * *